US005135077A

United States Patent [19]

Shalders

[11] Patent Number: 5,135,077

[45] Date of Patent: Aug. 4, 1992

[54] SCAFFOLDING SYSTEM

[75] Inventor: Alan J. Shalders, Purdys, N.Y.

[73] Assignee: Universal Builders Supply, Inc., Mount Vernon, N.Y.

[21] Appl. No.: 744,000

[22] Filed: Aug. 12, 1991

[51] Int. Cl.[5] ..... E04G 1/14; E04G 1/30; E04G 5/04

[52] U.S. Cl. ..... 182/82; 182/130; 182/178; 182/179; 182/118

[58] Field of Search ..... 182/118, 119, 132, 130, 182/178, 179, 82, 229; 52/608

[56] References Cited

U.S. PATENT DOCUMENTS

| | | | |
|---|---|---|---|
| 1,409,559 | 3/1922 | McLeod | 182/130 |
| 1,890,029 | 12/1932 | Delfs | 182/119 |
| 2,593,122 | 4/1952 | Droeger | 182/119 |
| 3,121,470 | 2/1964 | Stone | 182/178 |
| 3,392,801 | 7/1968 | Gethmann | 182/118 |
| 3,438,460 | 4/1969 | Solari | 182/132 |
| 3,486,579 | 12/1969 | Blomgren | 182/132 |
| 3,791,486 | 2/1974 | Marnoch | 182/132 |
| 3,850,264 | 11/1974 | Salinas | 182/178 |
| 4,089,389 | 5/1978 | Olsson | 182/119 |

FOREIGN PATENT DOCUMENTS

| | | | |
|---|---|---|---|
| 516678 | 1/1953 | Belgium | 182/132 |

OTHER PUBLICATIONS

Photocopy of photograph of prior art Scaffolding System.

Universal Builders Supply Inc. brochure, *Sectional Scaffolding, Pipe and Clamp.*

*Primary Examiner*—Reinaldo P. Machado

*Attorney, Agent, or Firm*—Brumbaugh, Graves, Donohue & Raymond

[57] ABSTRACT

A basic scaffolding tower assembly for building up, in modular fashion, a multi-level scaffolding system includes a pair of load-bearing tower panels spaced from and parallel to the building facade. The tower panels are joined together by a pair of landing channels extending perpendicularly to the building facade, thereby forming a generally rectangular tower structure. The landing channels support a work deck running parallel to the building facade, and the tower panels are spaced apart sufficiently to provide a drive-through passageway along the work deck wise enough for motorized construction equipment. Extension members carried by the landing channels extend inwardly towards the building facade and support, in cantilever fashon, a four foot or wider work deck immediately adjacent the facade. The tower assembly components are made of aluminum and are sufficiently robust to support twenty or more work levels.

13 Claims, 4 Drawing Sheets

SCAFFOLDING SYSTEM

BACKGROUND OF THE INVENTION

This invention relates to scaffolding structures and systems and more particularly to sectional metal scaffolding structures and systems which provide a deep cantilevered work deck adjacent to the building facade and an adjoining drive-through passageway for motorized construction equipment.

The basic building block of sectional scaffolding systems is the load-bearing panel. Load-bearing panels are generally rectangular, planar units which can be vertically stacked to form multilevel structures. Typically the panels are constructed of two tubular legs coupled together by a variety of cross pieces. Some designs include an opening large enough to permit a person to pass through parallel to the building facade.

In conventional scaffolding systems vertically stacked sets of load-bearing panels are arranged perpendicular to the facade of a building. Horizontally adjacent sets of panels are generally spaced about 6–8 feet apart. Scaffolding planks extend horizontally between the adjacent panels so as to provide a work area between the panels which is generally about 4–5 feet deep. While the prior art panels with openings can permit persons to pass through, they are not large enough to accommodate vehicles such as motorized buggies and pallet handling equipment.

Access to the building facade in conventional scaffolding structures is generally provided by a work deck which is supported by ancillary brackets attached to the inner legs of the panels. The work decks are typically only 1–2 feet wide, which is rather restricted for the performance of construction and maintenance tasks. Such work decks cannot accommodate any sort of practical vehicular traffic.

Load-bearing panels used in conventional scaffolding systems typically employ panels with a tubular legs of approximately 1⅝" diameter and approximately 0.093" wall thickness. This allows for working loads of 2500 to 3500 pounds, depending upon the structural efficiency of the leg bracing, at a required 4:1 safety factor, which permits only 3 or 4 levels of decking to be utilized.

It is an object of this invention to provide a scaffolding system with a drive-through passageway wide enough to accommodate motorized vehicles and work decks of sufficient width to facilitate enhanced freedom of movement of men and materials at and along the building facade.

It is a further object of this invention to provide a scaffolding system which can accommodate a substantially increased number of work deck levels.

Still another object of the invention to provide an improved scaffolding system which overcomes the aforementioned shortcomings of the prior art while permitting the integration, without modification, of conventional ancillary construction equipment, e.g., hoists, dirt chutes, stairs, etc.

It is a further object of the invention to provide a simple tie-back system for anchoring the scaffolding system to the building structure which readily accommodates differential expansion of the scaffolding structure relative to the building while safely transferring wind and other external loads to the building structure.

SUMMARY OF THE INVENTION

The foregoing and other objects are attained, in accordance with the invention, by the provision of a basic scaffolding tower assembly which is adapted to be stacked vertically and interconnected horizontally with other such basic tower assemblies to form a multi-level scaffolding system along a building structure. Each basic tower assembly includes a pair of load-bearing tower panels arranged parallel to the building facade and spaced therefrom and from each other, in horizontally aligned relationship, in the direction generally perpendicular to the building facade. A landing channel extending generally perpendicular to the building facade interconnects the two tower panels at either horizontal end thereof, thereby forming a generally rectangular tower assembly. The landing channels include horizontal members which are aligned vertically to define a horizontally plane for carrying a work deck structure.

In accordance with the invention, the horizontally extending landing channel members are the only horizontal members which interconnect the tower panels, so that a substantially obstruction-free passageway parallel to the building facade is provided between the two tower panels. Preferably, the tower panels are sufficiently spaced apart, e.g. at 8 foot centers, to allow motorized construction vehicles to be driven through the passageway. This greatly facilitates the movement of men and material along the building structure and thereby affords substantial economies of time and labor relative to prior scaffolding structures, which could not accommodate motorized vehicles.

As another feature of the invention, the basic tower assembly includes a pair of horizontally extending extension members, one of which is carried by each landing channel. The extension members extend towards the building facade, preferably being cantilevered from the landing panels for that purpose, and define a horizontally extending plane for carrying an obstruction-free work deck surface on the building side of the adjacent tower panel, i.e. immediately adjacent the building facade. In accordance with the invention, the adjacent tower panel is spaced from the building face by a sufficient distance and the extension members are sufficiently long to provide a generous, e.g. 4 feet deep, work area along the building facade. Such a deep work area directly at the workface greatly facilitates and speeds construction, with attendance savings in time and labor.

As still a further feature of the invention, a tie-back mechanism may be provided adjacent the inner ends of the two extension members for anchoring the basic tower assembly to the building structure for transfer of wind and other external loads on the scaffolding system to the building structure. The tie-back mechanism preferably includes the capability of accommodating differential expansion and contraction of the scaffolding structure relative to the building system in both horizontal and vertical directions.

BRIEF DESCRIPTION OF THE DRAWINGS

For a better understanding of the invention, reference may be made to the following description of an exemplary embodiment thereof taken in conjunction with the accompanying drawings, in which.

DETAILED DESCRIPTION OF PREFERRED EMBODIMENTS

Figure 1:
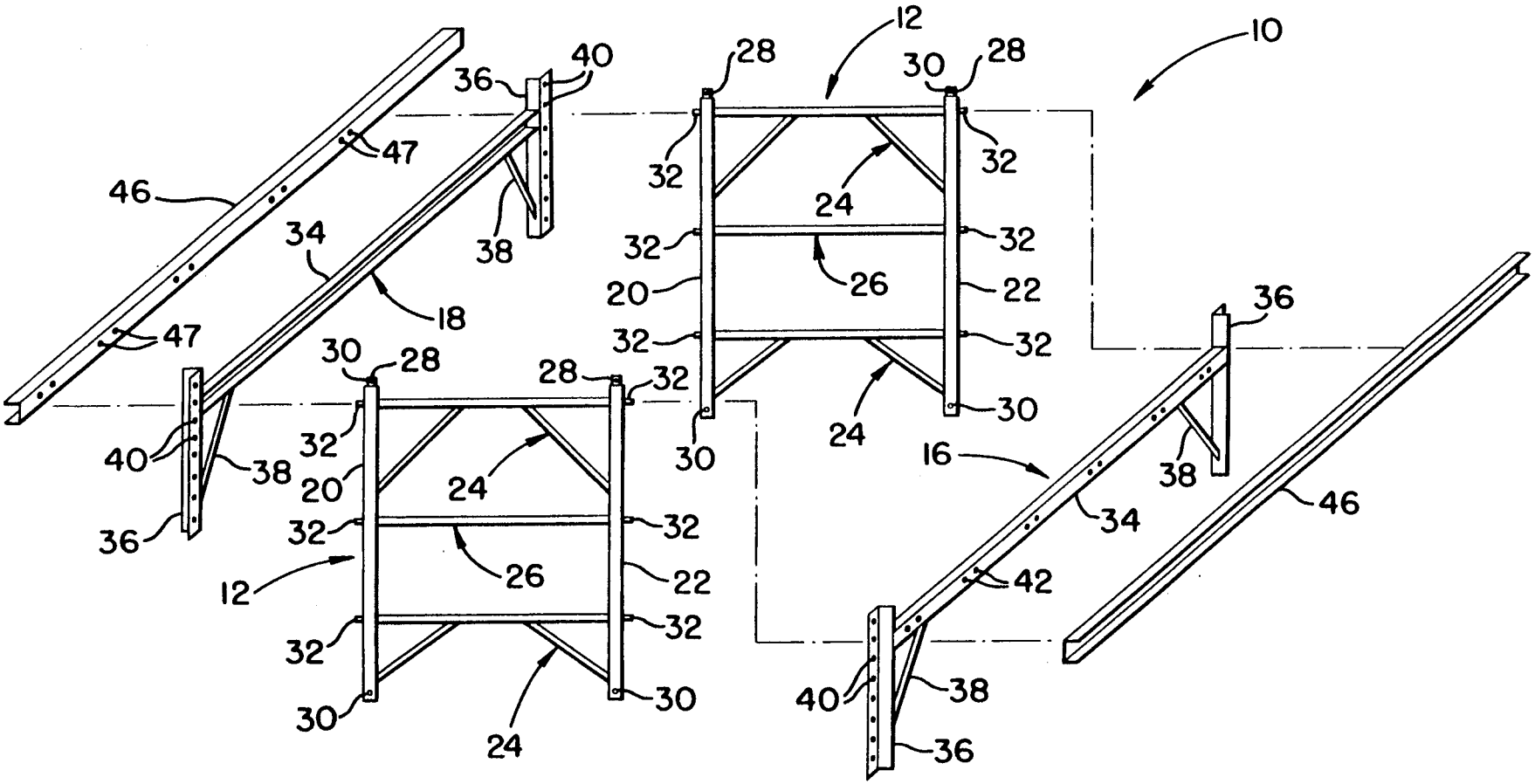
FIG. 1 is as exploded perspective view showing the basic tower assembly of the invention.
Figure 2:
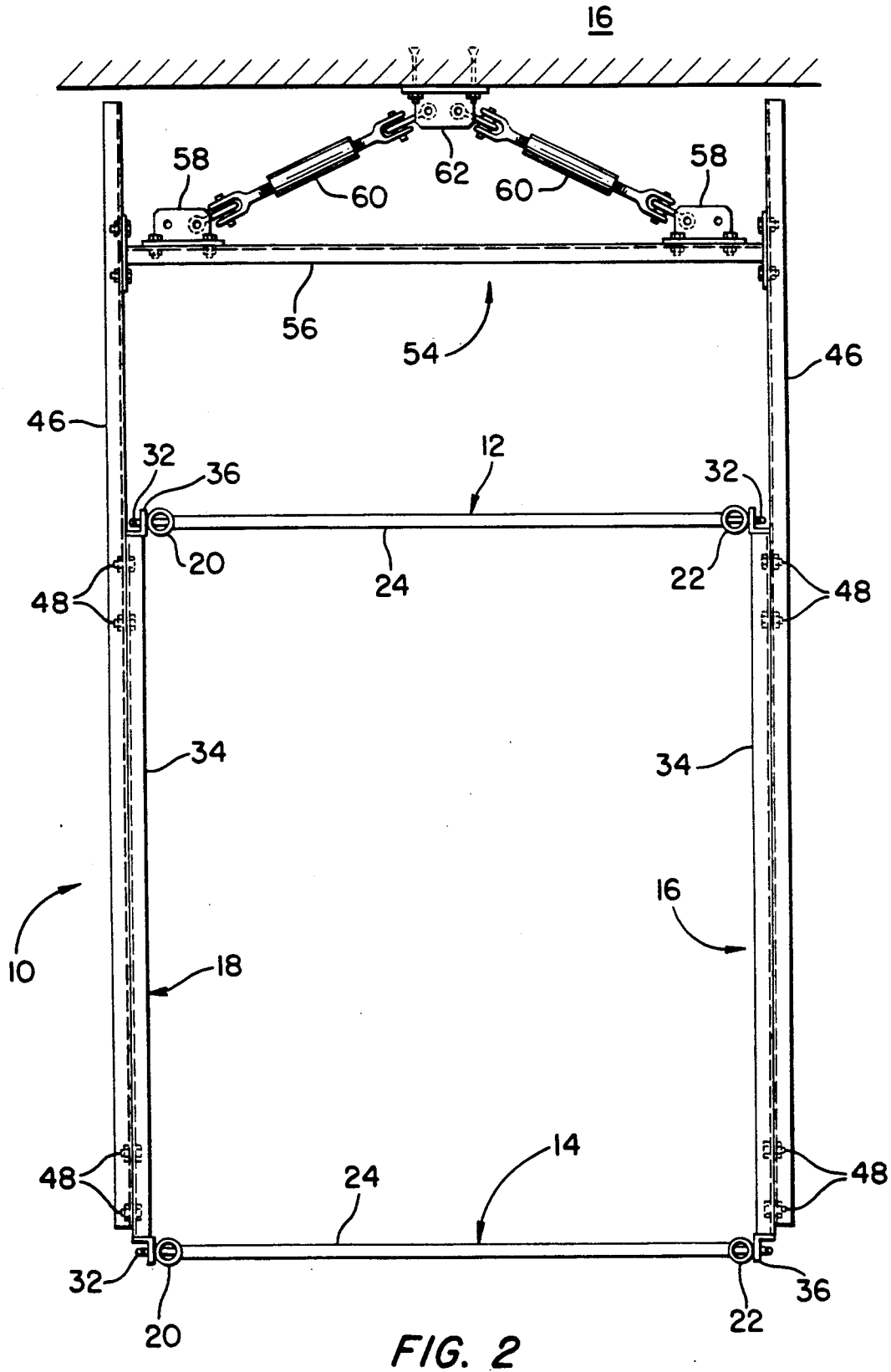
FIG. 2 is a horizontal sectional view of the basic tower assembly of the invention and also showing the cantilever structure for supporting the facade work deck and the tie-back system for attaching the tower assembly to the building.

In the illustrative embodiment of the invention shown in FIGS. 1 and 2, the basic scaffolding tower assembly 10 includes a pair of load-bearing tower panels 12 and 14 which are arranged substantially parallel to one another and to the building structure 16 (see FIG. 2). The tower panels 12 and 14 are spaced apart from the building structure and from each other in the direction generally perpendicular to the building facade, with the panel 12 being closer to the facade than the panel 14, and they are aligned horizontally in that same direction. The horizontally aligned upper ends of the panels 12 and 14 are interconnected by a pair of landing channels 16 and 18, thereby forming a generally rectangular assembly. The tower panels 12 and 14 are substantially identical to one another, as are the landing channels 16 and 18.

Each tower panel 12, 14 comprises two vertical members 20, preferably tubular, which are interconnected by structural cross bracing trusses 24 and a central strut 26. The panel components are preferably aluminum and are preferably welded together for structural integrity. The upper end of each tubular member 20 is formed with a projection 28 which is sized and adapted to fit within the lower end of the tubular member 20 of a vertically adjacent panel, thereby permitting stacking of the tower panels to form a multi-level scaffolding system. The projections 28 and the lower ends of the tubular members 20 are apertured, as at 30, for receipt of a locking bolt, lynch pin or other anchor member. The horizontal members of the bracing trusses 24 and the strut 26 carry studs 32 which extend through the vertical members 20 for engagement with matching openings in the landing channels (or other structural components of the scaffolding system or ancillary construction equipment). As known in the art, the studs 32 are formed with one or more vertical bores for receipt of a lynch pin to secure the landing channels (or other components) in place. If desired, the lynch pin may be provided with a spring steel ring which snaps over the stud, after the pin has been inserted into a vertical bore of the stud, to lock the pin in place.

Although subject to variation to suit the requirements of the particular construction site, preferred dimensions for the tower panels 12 are 6'-6" high, 6'-0" wide, with the tubular members 20 being approximately 3½" in diameter and having wall thicknesses within the range of from 0.156" to 0.500". So dimensioned the panel weight is maintained within manhandleable proportions, while at the same time providing for allowable leg loads of from 10,000 to 22,000 pounds. This provides the capability of installing over 20 levels of decking by vertically stacking the basic tower assemblies 10 on one another, with the possibility of providing still additional levels by bolting reinforcing splints to the legs 20 of the lower tower panels 12, 14.

Each landing channel 16, 18 preferably comprises a horizontally extending U-shaped channel member 34 which is welded at each end to one leg of a vertically extending right angle member 36. The angle members 36 extend both above and below the channel member 34, and are further interconnected for structural purposes by oblique struts 38 which are welded between the lower portions of the angle members 36 and the channel member 34. The other leg of each angle member 36 is formed with a plurality of vertically spaced openings 40 for receipt of the mounting studs 32 of the tower panels 12 to facilitate assembly of the basic tower assembly 10. Likewise, the horizontal member 34 is formed with horizontally spaced openings 42 for attachment thereto of the extension members described hereinafter. The landing channel 16 is also preferably of welded aluminum construction.

Figure 3:
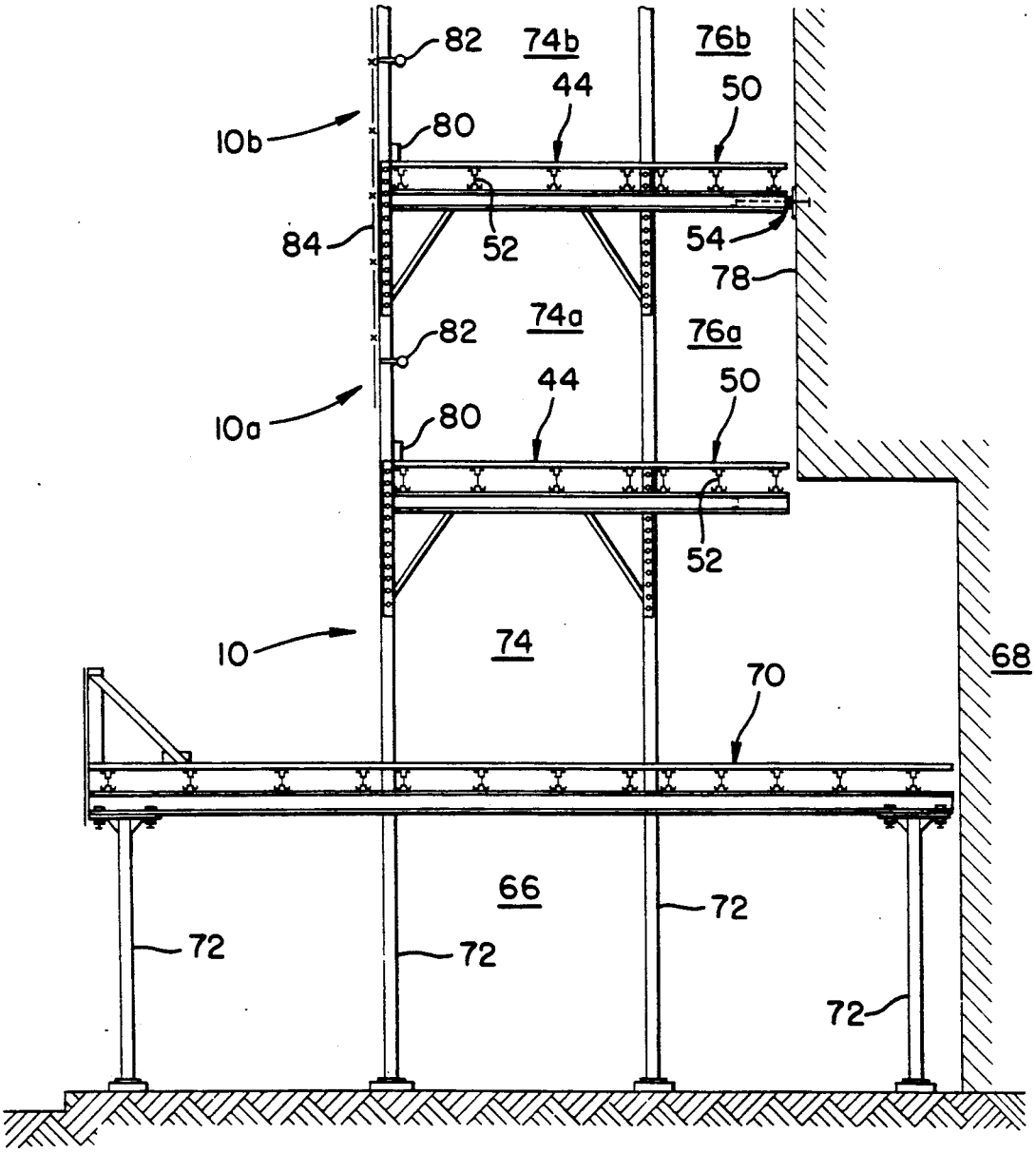
FIG. 3 is a vertical sectional view of a multi-level scaffolding system constructed in accordance with the invention.
Figure 4:
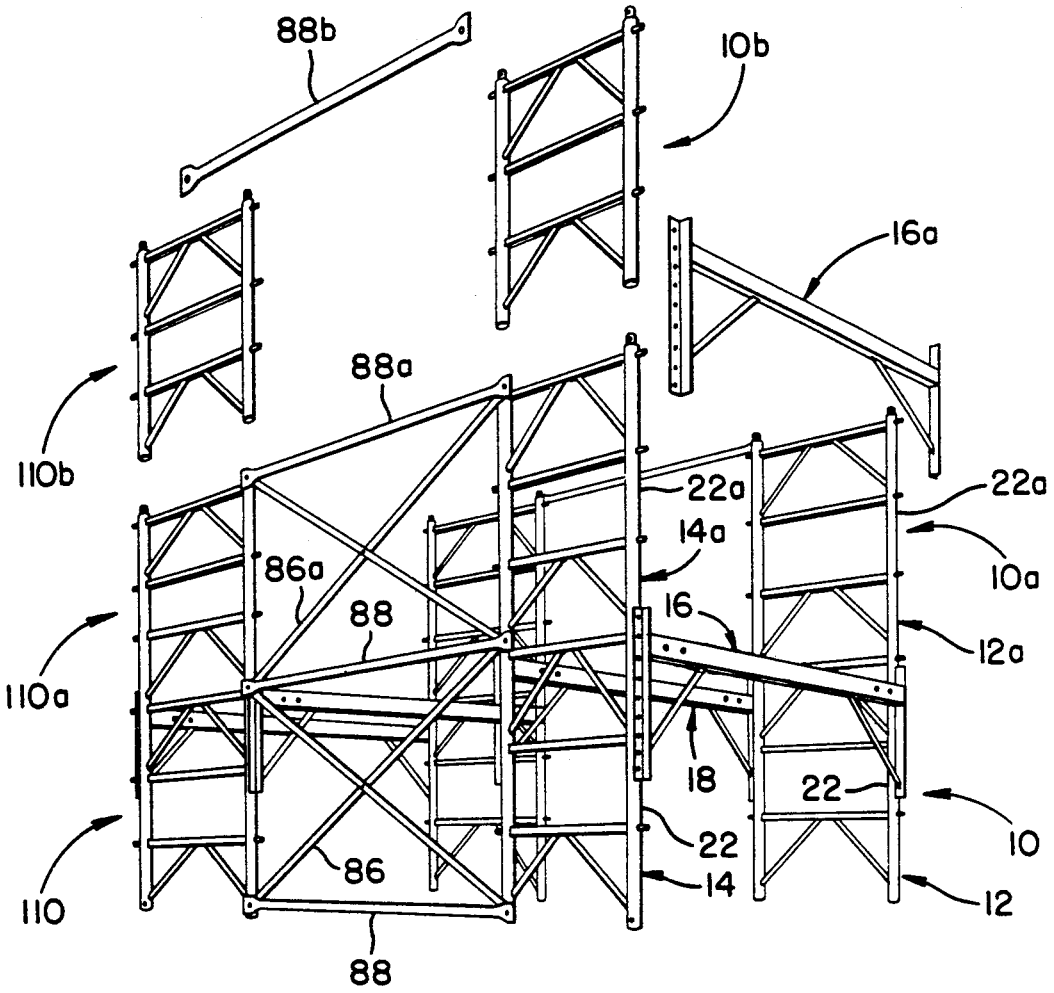
FIG. 4 is a partial perspective view of a scaffolding system according to the present invention, built up by combining together a plurality of basic tower assemblies.

In assembling the basic tower assembly 10, the mounting studs 32 of the tower panels are inserted into selected openings 40 of the angle members 36 such that the upper surfaces of the channel members 34 are vertically aligned so as to define a horizontal plane for receipt of decking structure 44 (see FIG. 3), and such that the angle members 36 overlap the juncture between vertically adjacent tower panels 12, **12*a* (see FIGS. 3 and 4). In addition, the generally U-shaped extension members 46 are bolted (as at 48 in FIG. 2) back-to-back to the U-shaped channel members 34 and extend inwardly towards the building structure 16. For that purpose, openings 47 are spaced along the length of the extension members 46 in alignment with the openings 42 in the landing channel members 34. The upper surfaces of the extension members 46 define a horizontal plane for supporting a deck structure 50 (see FIG. 3**) which provides a work area immediately adjacent the face of the building facade.

As with the tower panels 12, 14, the dimensions of the landing channels 16, 18 may be varied as desired to suit the needs of a given construction site. Preferably, however, the length of the landing channels is such as to space the tower panels at 8'-0" centers, which affords a 7'-6" obstruction-free passageway (below the level of the oblique braces 38). This provides a clear drive through area parallel to the building facade for the use of motorized buggies for efficient debris removal as well as the use of motorized pallet handling equipment and the like to deliver new material to the work zones. The ability of such motorized equipment to reach all work zones along the building site, regardless of height, greatly facilitates construction tasks and affords substantial savings in time and labor.

Access to the building facade itself is provided by the deck structure 50 carried by the cantilevered extension members 46. Preferably the inner tower panels 12 are set back from the facade sufficiently to allow for a 4'-0" deep work area between them and the facade. The extension members 46 are sized accordingly. For structural rigidity, the members 46 preferably overlap the full length of the channel members 34 (see FIG. 2).

The deck structures 44 and 50 may be conventional aluminum boards, plywood, scaffolding planks, etc., which are preferably supported on a system of extruded aluminum joists or ledgers 52 which are bolted or otherwise anchored to the channel members 34 and the extension members 46, respectively. The upper ends of the joists or ledgers 52 may be U-shaped for receipt of lengthwise extending wood inserts to facilitate nailing of the decking to the joists or ledgers.

Construction codes require that scaffolding structures be anchored to the building structure at specified minimum horizontal and vertical distances for purposes of transferring wind loads and other external loads on the scaffolding to the building structure. To that end, a tie-back assembly 54 (FIG. 2) may be provided adjacent the inner ends of the extension members 46. The assembly 54 includes a cross member 56 bolted to the members 46 and carrying two horizontally spaced L-shaped brackets 58, the upstanding leg of each of which pivotally receives one end of a pair of turnbuckles 60. The other ends of the turnbuckles 60 are pivotally connected to the upstanding leg of L-shaped bracket 62 anchored to the building structure. By appropriately adjusting the turnbuckles 60, the basic tower assembly 10 may be firmly yet flexibly secured to the building structure. As the dual turnbuckle structure permits pivotal movement about both horizontal and vertical axes, the tie-back assembly 54 can readily accommodate differential movement of the scaffolding structure relative to the building structure in both horizontal and vertical directions, such as frequently occurs, for example, due to thermally induced expansion and contraction of the metal scaffolding components.

FIGS. 3 and 4 illustrate how the basic tower assembly 10 may be used to build up, in modular fashion, a multi-level, horizontally extensive scaffolding system. FIG. 3 depicts the lower three levels of a multi-level system such as is typically assembled over a sidewalk area 66 adjacent to a building 68. The deck structure 70 of the first level is supported by conventional posts 72 and serves both as a work area and as a protective cover for the sidewalk area 66. Three basic tower assemblies 10, 10*a*, 10*b* are shown in vertical stacked relation, with each assembly providing a 7'-6" drive-through passageway 74, 74*a*, 74*b* and the assemblies 10*a*, 10*b* providing a 4'-0" work area 76*a*, 76*b* running parallel to the building facade 78. The basic tower assembly 10*a* is illustrated as having a tie-back assembly 54, whereas the basic assembly 10 does not. As also shown in FIG. 3, the basic tower assembly of the invention readily accommodates such conventional safety features as a toe board 80 and a guard rail 82. In addition, the superior structural strength of the basic tower assembly allows the use of solid, as distinct from ventilated, exterior cladding 84, such as heavy duty plastic, to serve as winter protection for construction activities, thereby improving working conditions and reducing lost time due to severe weather conditions during winter months.

The manner in which the tower assemblies 10 may be interconnected to form a scaffolding system is further illustrated in FIG. 4. To the basic tower assembly 10 shown at the lower right, a second assembly 10*a* is stacked vertically by nesting the legs of the tower panels 12*a*, 14*a* thereof with the legs of the tower panels 12, 14 of the assembly 10. The two assemblies are then connected by securing the landing channels 16, 18 in overlapping relation to the legs 20, 20*a* of the two assemblies 10, 10*a*. Additional levels may be added by stacking still more basic tower assemblies, as indicated partially at 10*b*, on top of the assembly 10*a*, and so mounted until the desired height of scaffolding is reached. Additional landing channels 16*a*, etc. are also provided as needed. Similarly, the scaffolding system may be extended horizontally by attaching additional tower assemblies 110, 110*a*, 110*b* to the assemblies 10, 10*a*, 10*b* respectively. This may be done by use of cross braces 86, 86*a*, etc. and/or girts 88, 88*a*, 88*b*, etc. By using conventionally sized cross braces 86 and girts 88, the scaffolding system of the invention may readily accommodate and integrate, without change, standard ancillary construction equipment, such as material hoists, personnel/material hoists, dirt chutes, hopper assemblies, access stairways and the like. The capability of accommodating such conventional ancillary equipment in combination with the wide drive-through passageways and facade work deck areas greatly facilitates and speeds material and personnel movement to and from the work sites, regardless of height. This affords substantial advantage relative to prior art scaffolding systems.

Although the invention has been described and illustrated herein with reference to specific embodiments thereof, it will be understood that such embodiments are susceptible of variation and modification without departing from the inventive concepts disclosed. All such variations and modifications, therefore, are intended to be included within the spirit and scope of the appended claims.

I claim:

1. A basic scaffolding tower assembly for positioning adjacent to the facade of a building structure, comprising;

first and second load-bearing tower panels, each tower panel comprising a pair of parallel vertically extending load-bearing legs interconnected by cross bracing members, said first tower panel being arranged generally parallel to and horizontally spaced from the building facade and said second tower panel being arranged generally parallel to and horizontally spaced from said first tower panel, said first and second tower panels being aligned with one another in the direction generally perpendicular to the building facade;

first and second landing channels extending generally perpendicularly to the building facade and interconnecting said first and second tower panels at the respective horizontal ends thereof, each said landing channel comprising a horizontal member extending between and coupled in load-bearing relation to the aligned vertical legs of said first and second tower panels adjacent the upper ends thereof, said horizontal members of said landing channels being vertically aligned so as to define a horizontally extending plane for carrying a work deck structure;

said first and second landing channel horizontal members comprising the only horizontally extending members interconnecting said first and second tower panels, such that the area between said first and second tower panels comprises a substantially obstruction-free passageway parallel to the building facade; and first and second extension members carried by said first and second landing channels and extending horizontally inwardly of said first tower panel towards said building facade, said first and second extension members being vertically aligned so as to define a horizontally extending plane for carrying a substantially obstruction-free work deck structure immediately adjacent the building facade.

2. The scaffolding tower assembly of claim 1 wherein each landing channel is approximately 8 feet or greater in length so as to provide a substantially obstruction-free passageway of approximately 7'-6" or greater in width.

3. The scaffolding system of claim 2 wherein said first and second extension members extend horizontally inwardly of said first tower panel by at least 4 feet to provide for a work deck structure of at least 4 feet in width.

4. The scaffolding tower assembly of claim 1 wherein each landing channel comprises a pair of vertically extending members, one attached to each of said horizontal members so as to extend partly above and partly below said horizontal member, and an oblique bracing member extending between a lower part of said vertically extending member and said horizontal member, said lower part of each vertically extending member being connected in load transmitting relation to the adjacent one of said vertically extending legs of said first and second tower panels.

5. The scaffolding tower assembly of claim 1 further comprising means carried by said extension members for tying the tower assembly to the building structure to transfer external loads on the scaffolding assembly to the building structure.

6. The scaffolding tower assembly of claim 5 wherein said tying means comprises means for allowing differential expansion and contraction of the scaffolding tower assembly relative to the building structure.

7. The scaffolding tower assembly of claim 1 wherein:

each vertically extending member of said landing channels comprises a plurality of vertically-spaced openings along the length thereof; and each vertically extending leg of said tower panels includes means for engaging at least one of said openings to secure the associated landing channel and tower panel together.

8. The scaffolding tower assembly of claim 7 wherein each of said vertically extending members of said landing channels is generally right angle shaped in horizontal cross section, with one leg thereof being connected to the adjacent end of the horizontal member of the landing channel and the other leg thereof being formed with said plurality of vertically spaced openings.

9. The scaffolding tower assembly of claim 1 wherein the vertical extending legs of said tower panels comprise means at the upper and lower ends thereof for nesting in load transmitting relation with the lower and upper ends, respectively, of the vertically extending legs of vertically adjacent tower panels, whereby said tower assemblies may be stacked to form a multi-level scaffolding system.

10. The scaffolding tower assembly of claim 9 further comprising means carried by said vertically extending legs of said tower panels for attachment thereto of cross bracing means for connection to the vertical extending legs of a horizontally adjacent tower panel, whereby a plurality of said basic tower assemblies may be connected together to form a scaffolding system extending horizontally along the building facade.

11. The scaffolding tower assembly of claim 9 further comprising means carried by said vertically extending legs of said tower panels for attachment thereto of horizontally adjacent standard ancillary construction equipment, whereby said standard ancillary construction equipment may be integrated into said scaffolding system.

12. The scaffolding tower assembly of claim 1 wherein each of said horizontal members of said landing channels and each of said first and second extension members is generally U-shaped in vertical cross section, with respective ones of said extension members and said horizontal members being secured together in back-to-back relation.

13. The scaffolding tower assembly of claim 1 wherein each of said vertically extending legs of said tower panels comprises a tubular aluminum member of approximately 3½" in diameter with a wall thickness within the range of from 0.156" to 0.500".

* * * * *